US007677507B1

(12) United States Patent
Rothbauer et al.

(10) Patent No.: US 7,677,507 B1
(45) Date of Patent: Mar. 16, 2010

(54) BAG RACK

(75) Inventors: Joseph David Rothbauer, Woodbury, MN (US); Mitchell William Knoll, Eagan, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 12/271,377

(22) Filed: Nov. 14, 2008

(51) Int. Cl.
*B65B 67/04* (2006.01)

(52) U.S. Cl. ..... 248/99; 248/95; 248/100

(58) Field of Classification Search ..... 248/302, 248/303, 95, 99, 100, 214, 220.21; 211/85.15, 211/100, 119, 181.1
See application file for complete search history.

(56) References Cited

U.S. PATENT DOCUMENTS

| | | | | |
|---|---|---|---|---|
| 1,039,359 | A * | 9/1912 | Brown | 211/118 |
| 2,217,795 | A * | 10/1940 | Russell et al. | 211/100 |
| 4,723,743 | A | 2/1988 | Jenkins | 248/97 |
| 4,750,694 | A | 6/1988 | Bateman | 248/97 |
| 4,821,985 | A | 4/1989 | DeMatteis et al. | 248/97 |
| 4,840,335 | A | 6/1989 | Forman, Jr. et al. | 248/97 |
| 4,840,336 | A | 6/1989 | Stroh et al. | 248/97 |
| 4,858,862 | A | 8/1989 | Prader | 248/99 |
| 5,190,253 | A | 3/1993 | Sable | 248/97 |
| 5,205,435 | A | 4/1993 | Daniels | 221/44 |
| 5,301,832 | A | 4/1994 | Daniels | 221/44 |
| 5,419,452 | A | 5/1995 | Mueller et al. | 220/440 |
| RE35,207 | E | 4/1996 | Daniels | 221/44 |
| 6,042,063 | A | 3/2000 | Kerr et al. | 248/100 |
| 6,089,514 | A | 7/2000 | Huang et al. | 248/99 |
| 6,299,001 | B1 * | 10/2001 | Frolov et al. | 211/106 |
| 6,488,246 | B2 * | 12/2002 | Song | 248/175 |
| 2007/0144988 | A1 * | 6/2007 | Alvarado | 211/85.15 |
| 2008/0149785 | A1 | 6/2008 | Galle | 248/97 |

* cited by examiner

*Primary Examiner*—Amy J Sterling
(74) *Attorney, Agent, or Firm*—Theodore M. Magee; Westman, Champlin & Kelly, P.A.

(57) ABSTRACT

A fixture is provided for a bag rack. The fixture has a wire frame with two mounting plates on it for mounting the fixture to two alternative locations on a bag rack. Two fixtures are mounted to each bag rack. Each fixture includes multiple rows of posts, with two posts in each row. Handles for a reusable bag are extended over arms on the bag rack and below the posts on the fixtures to keep the reusable bag open during filling.

9 Claims, 7 Drawing Sheets

BAG RACK

BACKGROUND

In the retail industry, fixtures have been developed to hold shopping bags open to make it easier to quickly fill the shopping bags with purchased items. These fixtures are designed to accommodate disposable shopping bags that have known dimensions and shapes. The dimensions and shapes of the bags are known because retailers typically purchase the disposable bags and provide them to their customers.

In an effort to reduce the number of shopping bags that are disposed of annually, an effort has arisen to use durable shopping bags that can be brought back to the store several times. Unfortunately, such reusable bags have different constructions from the typical disposable bags provided by retailers. In addition, a number of different sized and shaped reusable bags have been developed and sold. As a result, current retail fixtures cannot accommodate the variety of reusable bags that customers may want to use. Such bags must therefore be held by hand during filling, reducing the efficiency of store operations.

The discussion above is merely provided for general background information and is not intended to be used as an aid in determining the scope of the claimed subject matter.

SUMMARY

A fixture is provided for a bag rack. The fixture has a wire frame with two mounting plates on it for mounting the fixture to two alternative locations on a bag rack. Two fixtures are mounted to each bag rack. Each fixture includes multiple rows of posts, with two posts in each row. Handles for a reusable bag are extended over arms on the bag rack and below the posts on the fixtures to keep the reusable bag open during filling.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

A fixture is provided that can be mounted on existing bag racks to help hold a variety of different reusable bags during filling. This fixture includes a plurality of rows of posts. A handle of a reusable bag is draped over an arm on the bag rack and around one of the pairs of posts. Another handle of the bag is draped over a second arm of the bag rack and around a pair of posts on an identical fixture mounted to the other side of the bag rack. The plurality of posts is positioned on the fixtures so that the modified bag rack can hold open bags having different heights and handle lengths. For example, tall bags or bags with long handles would be supported by placing the handle under the lowest posts on the fixture while shorter bags or bags with shorter handles would be supported by replacing the handle around the top most posts on the fixtures.

The fixtures are symmetrical about a center plane such that the same fixture can be mounted to either side of an existing bag rack. Further, because the fixture can be fastened to existing bag racks, existing bag racks do not need to be replaced to accommodate the new reusable bags.

Figure 1:
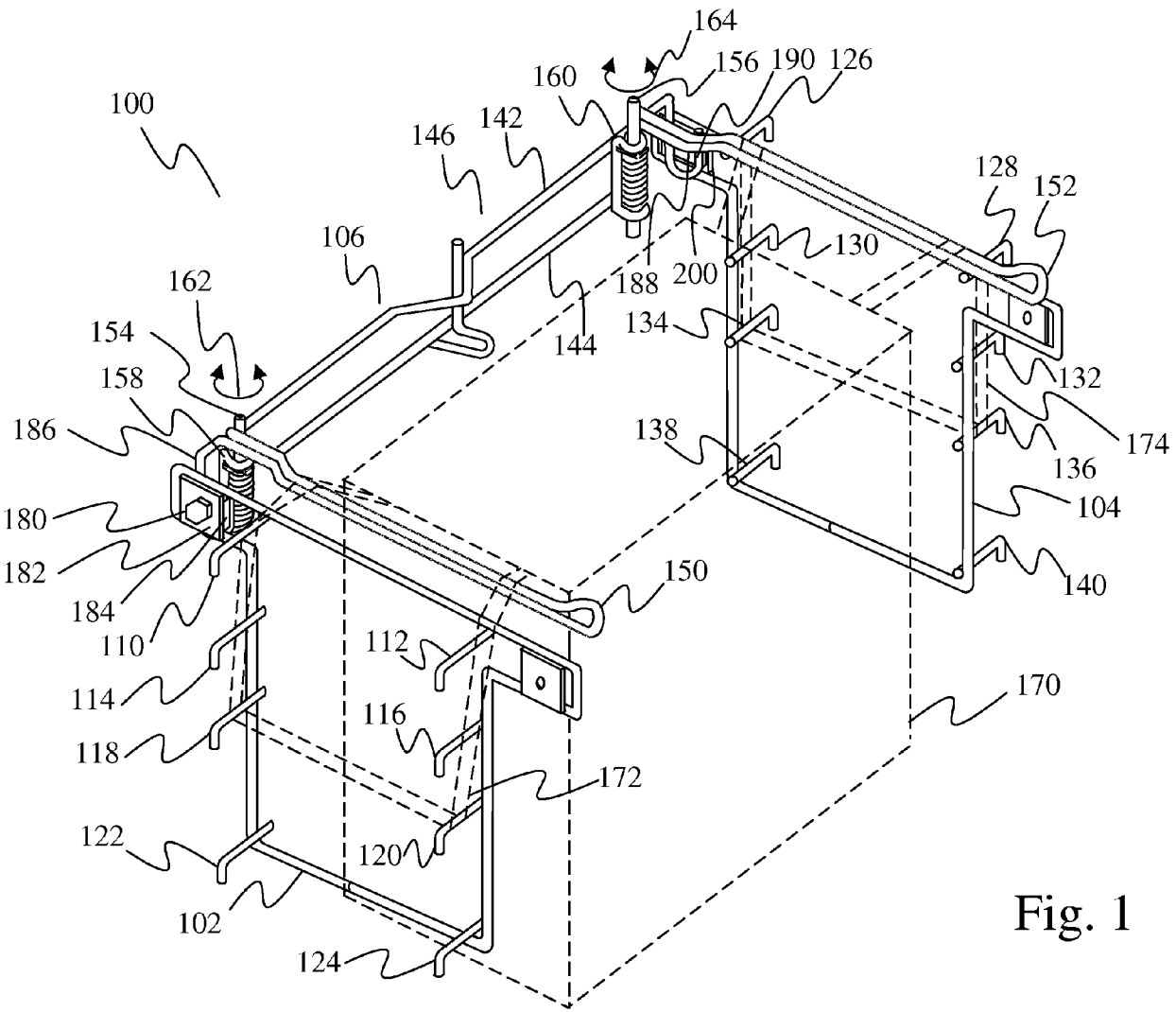
FIG. 1 is a perspective view of one embodiment of a bag rack having fixtures attached thereto.

FIG. 1 provides a perspective view of a bag rack assembly 100 under one embodiment that is able to accommodate a large number of different sized reusable bags. Bag rack assembly 100 includes fixtures 102 and 104 mounted to a bag rack 106. Fixture 102 is shown as having a plurality of posts 110, 112, 114, 116, 118, 120, 122, and 124 that are aligned in rows such that posts 110 and 112 are in a first row, posts 114 and 116 are in a second row, posts 118 and 120 are in a third row, and posts 122 and 124 are in a fourth row. In addition, the posts are vertically aligned such that post 110, 114, 118, and 122 are vertically aligned and posts 112, 116, 120, and 124 are vertically aligned. Similarly, fixture 104 includes posts 126, 128, 130, 132, 134, 136, 138, and 140, which are horizontally aligned in four rows and vertically aligned in two columns.

Bag rack 106 includes two arms 150 and 152 that are attached to respective posts 154 and 156, which are held in respective carriers 158 and 160. Post 154 can rotate within carrier 158 thereby allowing arm 150 to rotate in directions 162. Similarly, post 156 can rotate within carrier 160 thereby allowing arm 152 to be rotated in directions 164. Carriers 158 and 160 are welded to cross beams 142 and 144, which together with carriers 158 and 160 define a base 146.

As shown in FIG. 1, a bag 170 having handles 172 and 174 is placed within bag rack 100 between arms 150 and 152. Handle 172 is extended over arm 150 and under posts 118 and 120. Handle 174 is extended over arm 152 and under posts 134 and 136. In this configuration, the top of bag 170 is held in an open state allowing for items to be easily placed within bag 170. Handles 172 and 174 are each formed of a length of material that is attached to the top of bag 170 at locations separated by a distance. This distance and the distance between posts within a row help to maintain a bag in an open state.

In FIG. 1, fixture 102 is mounted to bag rack 106 using a fastener 180 that passes through a mounting plate or mounting piece 182 welded on fixture 102 and through a mounting piece 184 that is welded onto an extension 186 of arm 150. Similarly, fixture 104 is mounted to rack 106 by a fastener (not shown in FIG. 1) passing through a mounting plate 200 welded on fixture 104 and through a mounting piece 188 that is welded to an extension 190 of arm 152.

Figure 2:
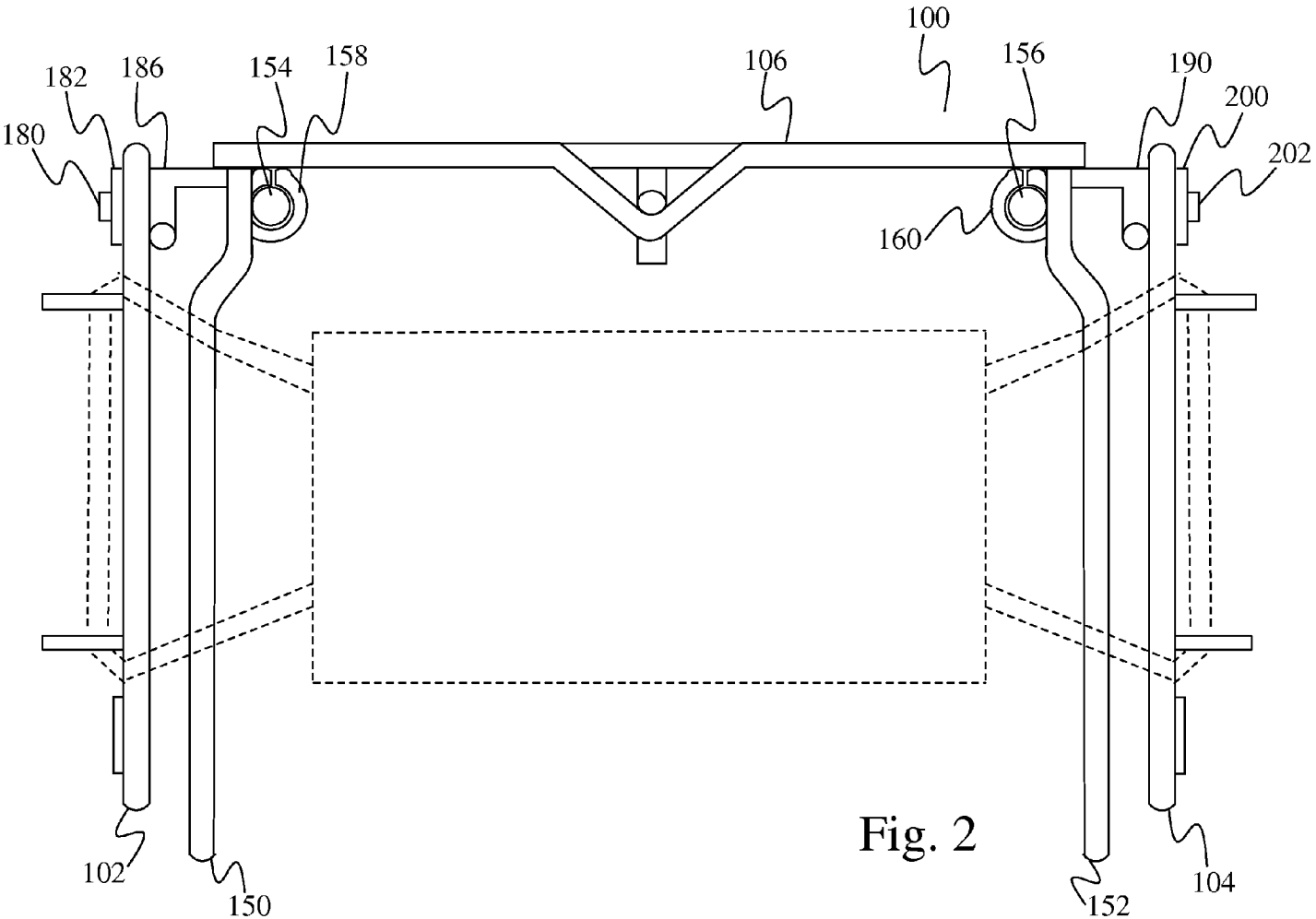
FIG. 2 is a top view of the bag rack and fixtures of FIG. 1.

FIG. 2 provides a top-view of bag rack assembly 100. In FIG. 2, fastener 180 is shown passing through mounting plate 182 to mount fixture 102 to bag rack 106. Similarly, fastener 202 is seen passing through mounting plate 200 of fixture 104 to mount fixture 104 to bag rack 106. In FIG. 2, mounting pieces 184 and 188 of back rack 106 are not visible because they are obscured by fixtures 102 and 104.

Figure 3:
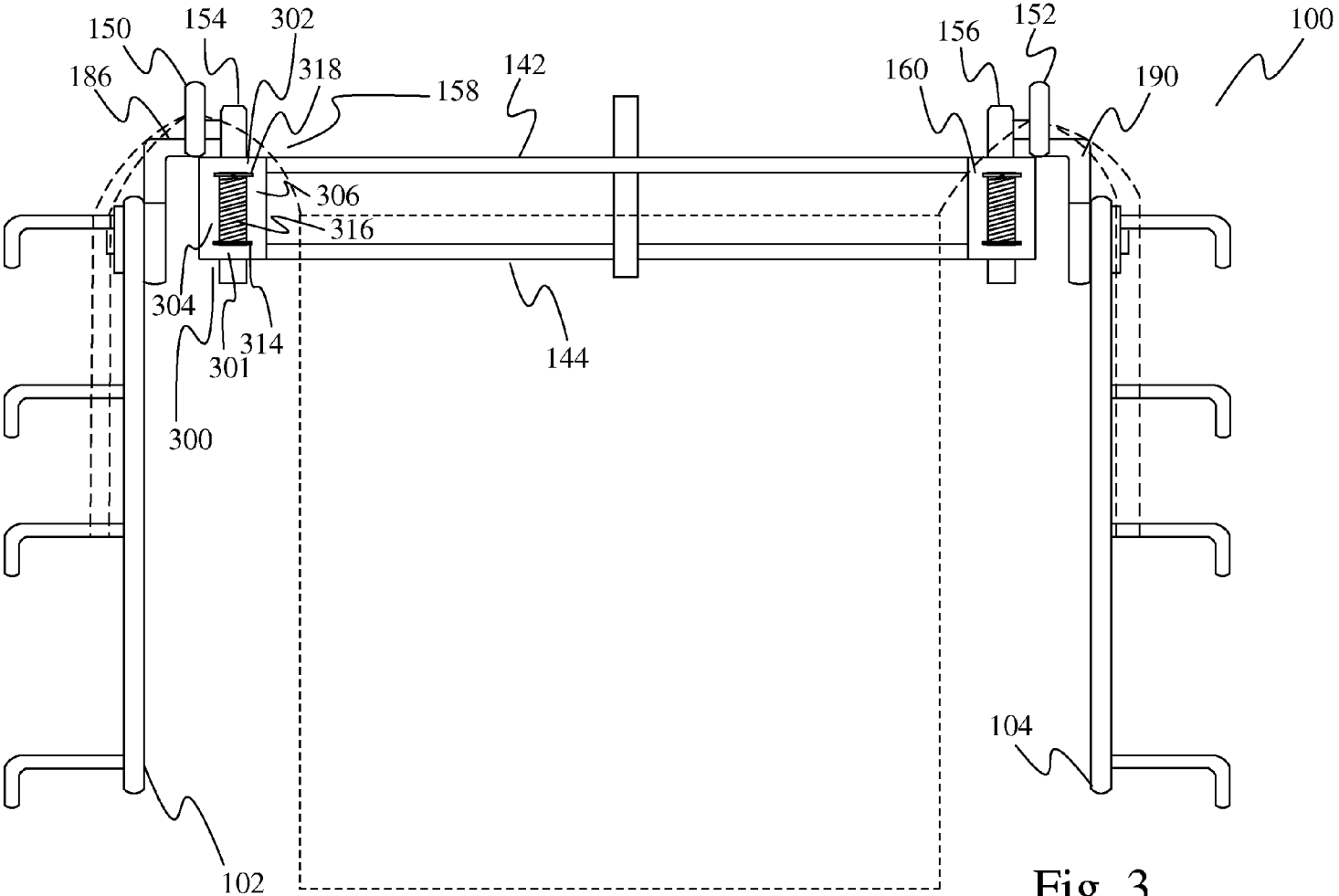
FIG. 3 is a front view of the bag rack and fixtures of FIG. 1.

FIG. 3 provides a front view of bag rack assembly 100. In FIG. 3, carrier 158 is shown to include an exterior frame 300 that includes a bottom U shaped portion 301, a top U shaped portion 302, and two vertical portions 304 and 306. A bottom disk 314 rests on bottom U shaped portion 301 and supports a spring 316. Spring 316 presses against a lateral pin in post 154 pushing it into an upper plate 318 mounted around post 154. In some embodiments, plate 318 includes one or more indented portions that are designed to receive the pin in post 154. Spring 316 tends to force the pin into contact with plate 318 and as a result, post 154 tends to prefer orientations in which the pin in post 154 is in a recess within plate 318. Carrier 160 has a similar construction.

Because fixtures 102 and 104 are mounted to extensions 186 and 190 of arms 150 and 152, fixtures 102 and 104 rotate with arms 150 and 152.

Figure 4:
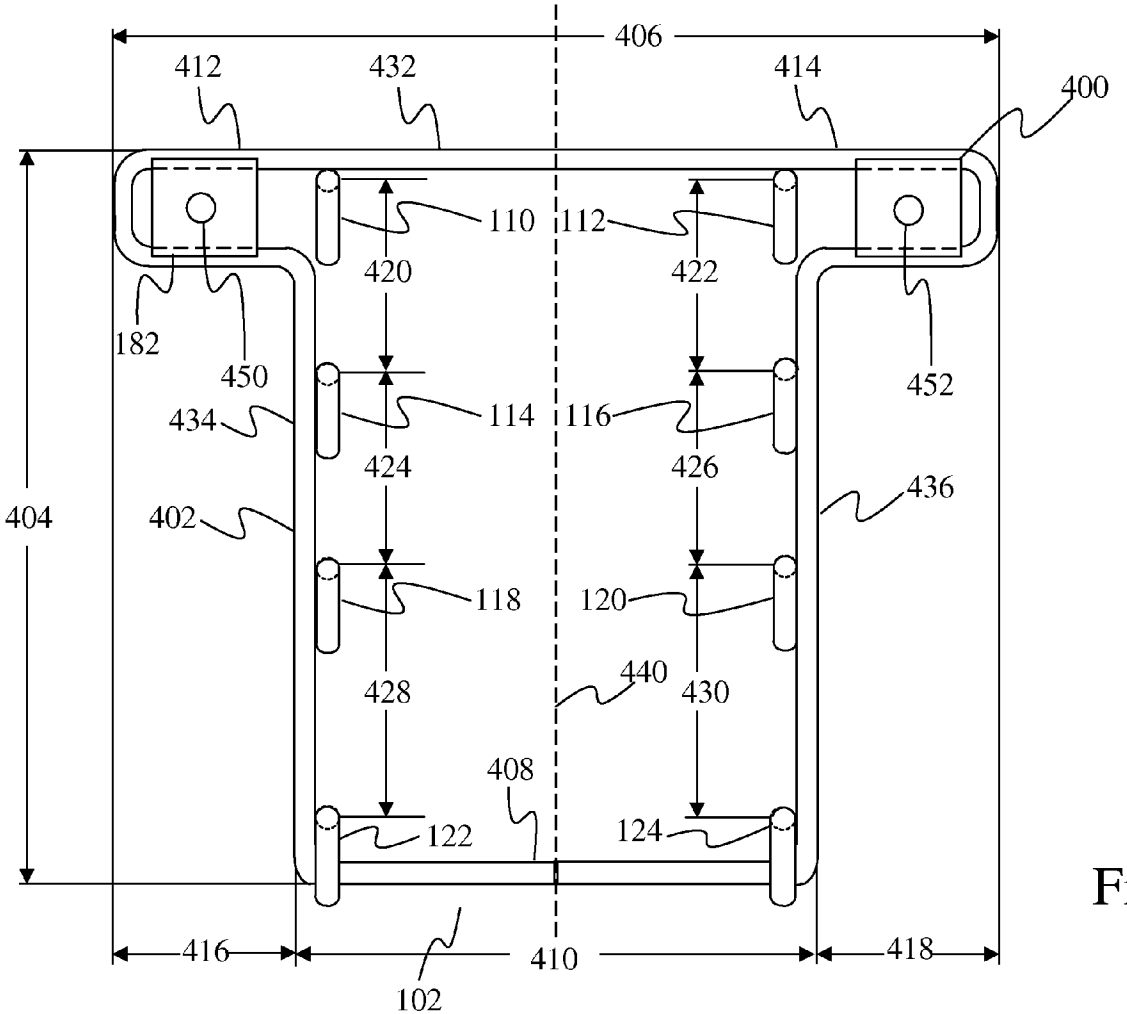
FIG. 4 is a side view of a fixture under one embodiment.

FIG. 4 is a side view of fixture 102. In FIG. 4, fixture 102 is shown to include a wire frame 402 to which posts 110, 112, 114, 116, 118, 120, 122, and 124 are welded. In addition, mounting plates 182 and 400 are welded to frame 402. Fixture 102 has a height 404, which under one embodiment is about 8 inches and a width 406, which under one embodiment is about 9.5 inches. Under one embodiment, frame 402 is made of a wire having a diameter of about 0.236 inches.

Frame 402 consists of a core portion 408 having a width 410, which under one embodiment is about 6 inches and two mounting extensions 412 and 414 which have widths 416 and 418 that under one embodiment are each about 1.75 inches. Under one embodiment, mounting plates 182 and 400 are square and have a height and width of about 0.875 inches. Hole 450 is provided in mounting plate 182 and hole 452 is provided in mounting plate 400 to receive a fastener for mounting the fixture to a bag rack. Under one embodiment, each of holes 450 and 452 has a diameter of about 0.313 inches.

Posts 110 and 114 are aligned vertically but separated by a vertical distance of 420, which under one embodiment is about 2 inches. Similarly, posts 112 and 116 are aligned vertically but are separated by a vertical distance 422, which under one embodiment is also about 2 inches. Posts 114 and 118 are vertically aligned and separated by a vertical distance 424, which under one embodiment is about 2 inches. Posts 116 and 120 are vertically aligned and separated by a vertical distance 426, which under one embodiment is about 2 inches. Posts 122 and 118 are vertically aligned and separated by a distance 428, which under one embodiment is about 3 inches and posts 120 and 124 are vertically aligned and separated by a distance 430, which under one embodiment is also about 3 inches.

Posts 110 and 112 are welded to top rail 432 of frame 402. As such, they form a row of posts that also represents a set or pair of posts. Posts 114 and 116 form a second row of posts; posts 118 and 120 form a third row of posts; and posts 122 and 124 form a fourth row of posts. Posts 114, 118, and 122 are welded to side portion 434 of frame 402 and posts 116, 120, and 124 are welded to second side portion 436 of frame 402.

Fixture 102 has reflection symmetry through a reflection plane shown as dotted line 440. This reflection symmetry means that any point along fixture 102 on one side of the plane of symmetry 440 will have a counterpart on the other side of the plane 440 at the same distance from the plane 440. This reflection symmetry allows fixture 102 to be installed on either side of bag rack 106. Thus, fixture 104 in FIG. 1 is identical to fixture 102 in FIG. 1 and because of the reflection symmetry of these fixtures, either fixture could be installed on either side of bag rack 106 to produce rack assembly 100. As a result, fewer fixtures need to be designed and constructed. The reflection symmetry extends to the mounting plates and posts on fixture 102 as well as frame 402.

Figure 5:
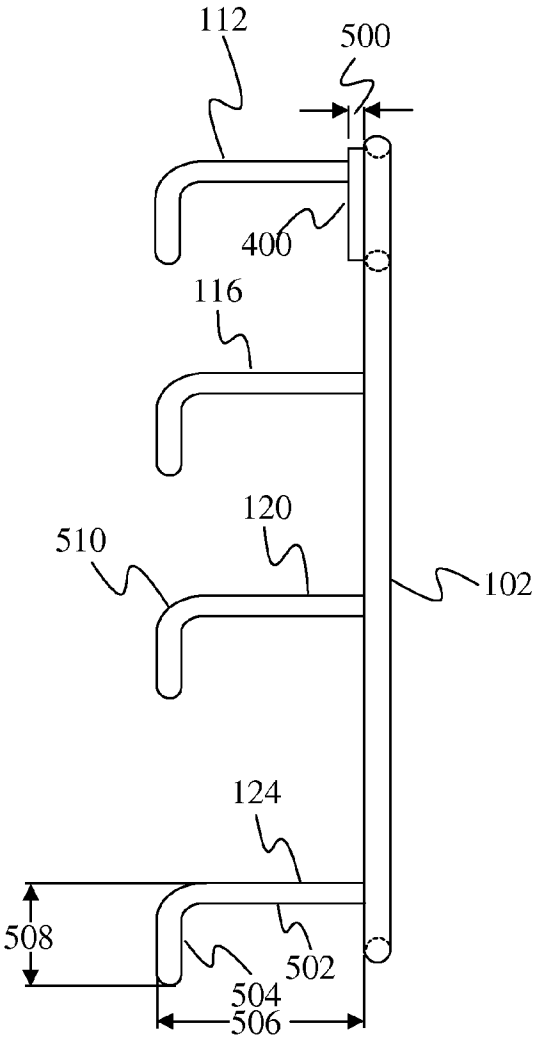
FIG. 5 is a front view of the fixture of FIG. 4

FIG. 5 provides a front view of fixture 102. In FIG. 5, mounting plate 500 is shown as having a thickness 500, which under one embodiment is about 0.102 inches. Each of posts 112, 116, 120, and 124 have a similar shape which is shown in FIG. 5 to have a lateral portion 502 and a downwardly curved portion 504 as shown for post 124. The posts extend laterally a distance 506, which under one embodiment is about 0.5 inches and extend downwardly by a distance 508, which under one embodiment is about 1 inch. Under one embodiment, the posts have a radius of curvature 510 of about 0.5 inches.

In other embodiments, the posts on fixture 102 may not include a downwardly curved portion. In other embodiments, the end of the lateral portion opposite where the post is welded to the frame may be angled upward or downward relative to the portion welded to the frame. In other embodiments, the downwardly curved portion is replaced with a knob portion. The orientation and shape of the posts may be chosen to ensure that the handles of the bag are held securely during bag filling, to make it easy to place the handles on the posts and to make it easy to remove the handles from the posts after filing.

Figure 6:
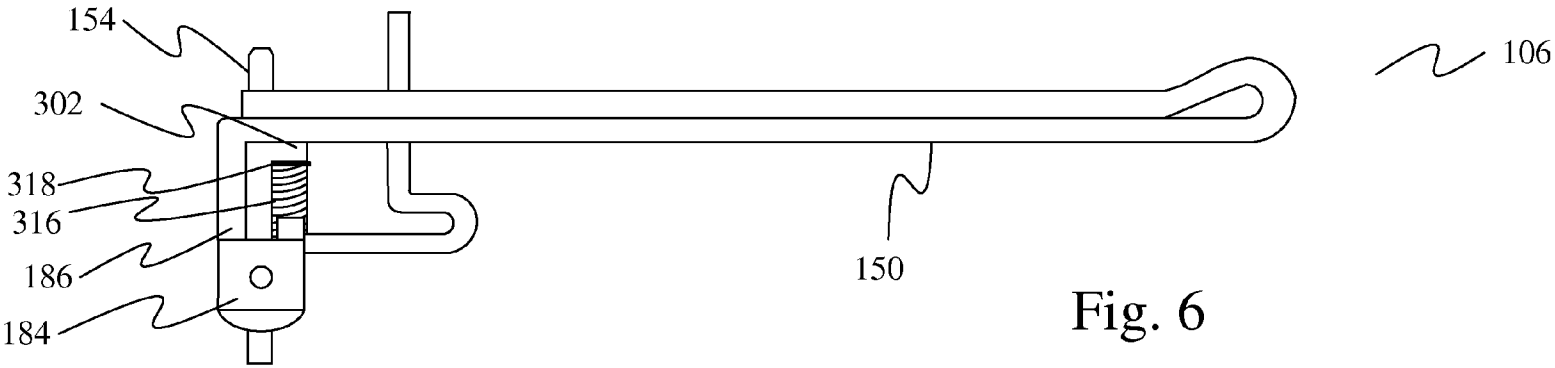
FIG. 6 is a side view of a bag rack without a fixture.

FIG. 6 provides a side view of bag rack 106 without fixtures 102 or 104. In the side view of FIG. 6, mounting member 184 on support arm extension 186 can be seen more clearly.

Figure 7:
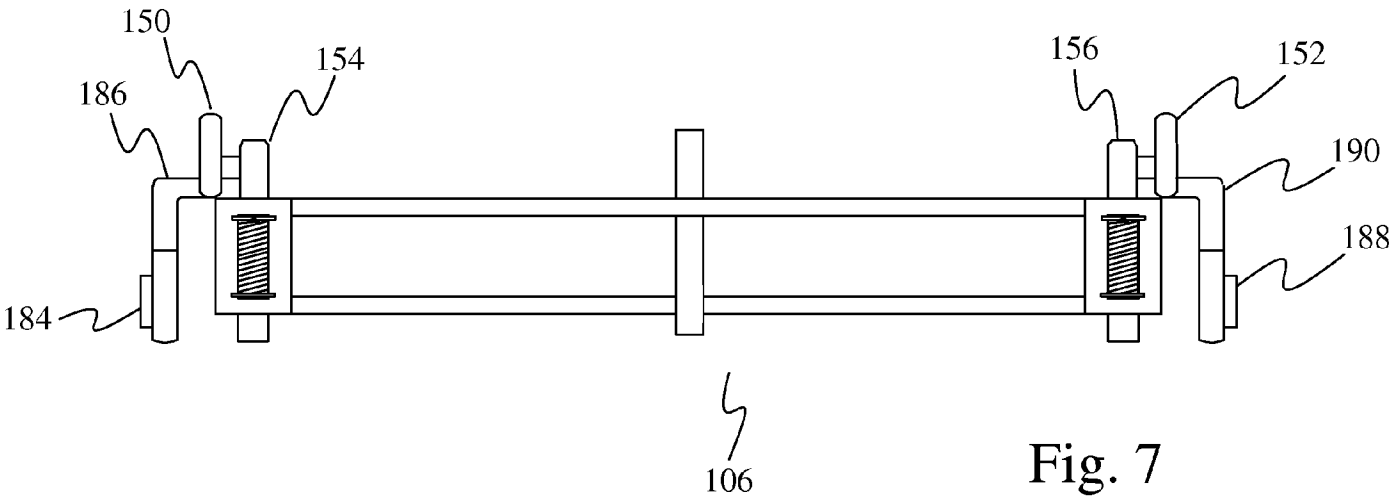
FIG. 7 is a front view of a bag rack without a fixture.

FIG. 7 provides a front view of bag rack 106 showing mounting numbers 184 and 188 on support arm extensions 186 and 190 respectively.

Figure 8:
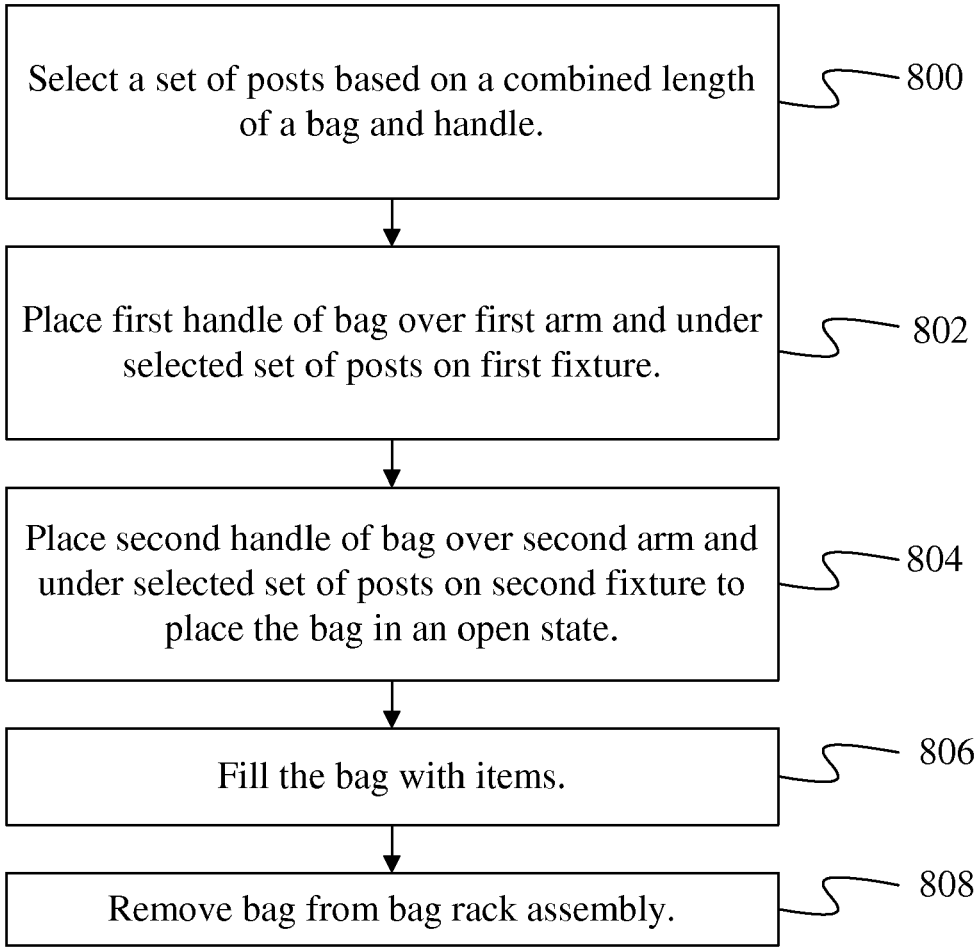
FIG. 8 is a flow diagram of a method of filling bags using the bag rack and fixtures of FIG. 1.

FIG. 8 provides a flow diagram for changing the state of a reusable bag from a closed unsupported bag to an open fully supported bag. In step 800, a set of posts on fixtures 102 and 104 are selected based on the combined length of the reusable bag and the handles. In this context, a set of posts is a pair of posts in a row of posts as discussed above. The combined length of a bag and a handle is the distance from the bottom of the bag to a position on a handle that is the furthest away from the bottom of the bag when the handle is fully extended.

After selecting the set of posts, the first handle of the bag is placed over the arm 150 of bag rack 106 and under the selected set of posts on fixture 102 at step 802. The second handle of the bag is placed over arm 152 of bag rack 106 and under the selected set of posts on fixture 104 at step 804. As shown in FIG. 1, this places the bag in an open state such that the bag is either partially or fully supported by bag rack assembly 100. In step 806, the bag is filled with items before the handles are withdrawn from the posts on fixtures 102 and 104 to remove the bag from bag rack assembly 100 at step 808.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A bag rack assembly comprising:

a base;

a first arm coupled to a post retained by the base and capable of being rotated relative to the base;

a first mounting plate coupled to the first arm and capable of rotating with the first arm;

a first fixture having an attachment end attached to the first mounting plate by a fastener, the first fixture comprising at least two rows of posts, each row of posts comprising two posts, the first fixture capable of rotating with the first arm.

2. The bag rack assembly of claim 1 further comprising:

a second arm coupled to a post retained by the base and capable of being rotated relative to the base;

a second mounting plate coupled to the second arm and capable of rotating with the second arm;

a second fixture having an attachment end attached to the second mounting plate by a fastener, the second fixture comprising at least two rows of posts, each row of posts comprising two posts, the second fixture capable of rotating with the second arm.

3. The bag rack assembly of claim 2 wherein the first fixture comprises four rows of posts.

4. The bag rack assembly of claim 3 wherein each post comprises a lateral section and a downwardly curved end.

5. The bag rack assembly of claim 2 wherein the first fixture further comprises a first mounting piece at the attachment end that is attached to the first mounting member by the fastener.

6. The bag rack assembly of claim 5 wherein the first fixture further comprises a second mounting piece at a free end of the first fixture opposite the attachment end.

7. The bag rack assembly of claim 1 wherein the first fixture further comprises a wire frame wherein the posts are welded to the wire frame.

8. The bag rack assembly of claim 1 wherein a first post in a first row and a second post in a second row are vertically aligned.

9. The bag rack assembly of claim 2 further comprising a bag positioned between the first arm and the second arm with a first handle of the bag extending over the first arm and under two posts of a row of posts on the first fixture and a second handle of the bag extending over the second arm and under two posts of a row of posts on the second fixture.

* * * * *